United States Patent [19]

Brückner

[11] Patent Number: 4,478,408

[45] Date of Patent: Oct. 23, 1984

[54] HAND AND FOREARM PROTECTIVE DEVICE FOR THE INTERCEPTION OF THRUSTS IN MARTIAL ARTS

[76] Inventor: Georg F. Brückner, Hohenzollerndamm 174, D-1000 Berlin 31, Fed. Rep. of Germany

[21] Appl. No.: 331,611

[22] Filed: Dec. 17, 1981

[30] Foreign Application Priority Data

Dec. 22, 1980 [DE] Fed. Rep. of Germany ..... 3048467

[51] Int. Cl.[3] ..... A63B 69/34

[52] U.S. Cl. ..... 272/76; 2/16

[58] Field of Search ..... 273/67 R, 67 B, 55 R, 273/55 A; 272/76; 2/2, 18, 16, 17, 20; D2/361; 128/106

[56] References Cited

U.S. PATENT DOCUMENTS

| | | | |
|---|---|---|---|
| 2,635,240 | 4/1953 | Tausch | 2/18 |
| 2,763,864 | 9/1956 | Conrad, Jr. | 2/20 |
| 3,185,476 | 5/1965 | Fechner | 272/76 X |
| 3,396,969 | 8/1968 | Rosenfeld | 273/55 R |
| 3,558,135 | 1/1971 | Rees | 273/55 A |
| 3,903,546 | 9/1975 | Rhee | 2/18 X |
| 3,924,272 | 12/1975 | Allen et al. | 2/16 |
| 4,093,212 | 6/1978 | Jacques | 272/76 |
| 4,095,294 | 6/1978 | Winterbottom | 272/76 X |
| 4,290,147 | 9/1981 | Bruckner et al. | 2/18 |

FOREIGN PATENT DOCUMENTS

| | | | |
|---|---|---|---|
| 1071270 | 11/1952 | France | 128/89 R |

*Primary Examiner*—Richard J. Apley
*Assistant Examiner*—Chris Coppens
*Attorney, Agent, or Firm*—Herbert L. Lerner; Laurence A. Greenberg

[57] ABSTRACT

Hand and forearm protective device for the interception of thrusts in martial arts, including a polyurethane-integral foam mitt for an all-around covering of at least the hand and forearm area of a person, the mitt having a substantially parallelepipedal basic body having a central recess extended longitudinally therethrough for receiving the hand and forearm, the mitt having, in vicinity of an end third of the recess, a crosspiece projecting from one side of the recess into the cross section thereof and a gripping trough formed therein laterally adjoining the recess for holding the mitt with the hand.

5 Claims, 4 Drawing Figures

FIG.1
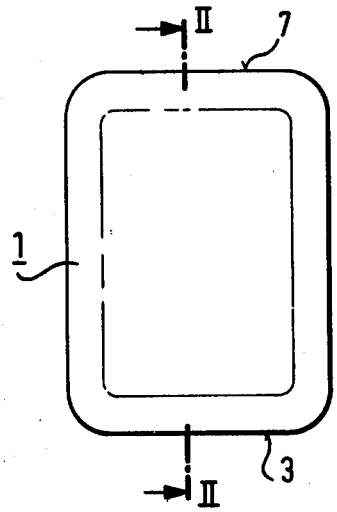
FIG.2
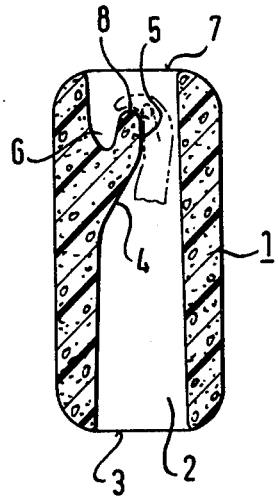
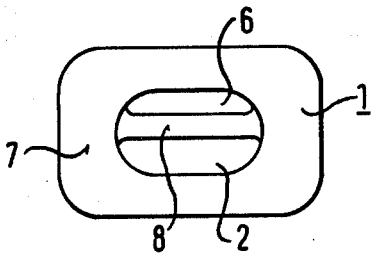
FIG.3
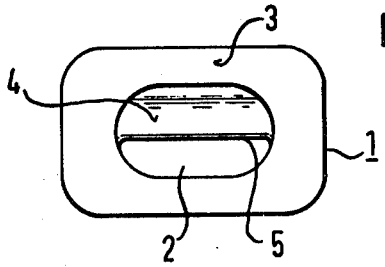
FIG.4

HAND AND FOREARM PROTECTIVE DEVICE FOR THE INTERCEPTION OF THRUSTS IN MARTIAL ARTS

The invention relates to a hand and forearm protective device for the interception of thrusts in martial arts, for example in body contact sports such as karate.

In martial arts such as these, the key attack and defense means employed are blows made with the fist and the forearm as well as thrusts administered with the foot and heel, which can deliver a considerable force. To avoid direct body hits, the opponent's main concern is to ward off these blows and thrusts in advance, for which the hand, the fist, and the forearm are best suited.

There is, however, a careful and constant training required for optimally learning to both apply and ward off these thrusts and blows in such a way that in the contest itself the danger of injury is minimized. To facilitate this training in practice, the requirement is for the attacked partner to sufficiently protect the hand and forearm. Though related attempts have been made to tape the hand and forearm with a soft, elastic material for cushioning the shock of hits to be parried, this protection, however, is not very effective and primarily is not very long lasting; furthermore, its respective application requires a considerable preparatory time.

It is accordingly an object of the invention to provide a hand and forearm protective device for the interception of thrusts in martial arts, which overcomes the hereinafore-mentioned disadvantages of the heretofore-known devices of this general type, and to create a hand and forearm protector, which can be simply applied and aside from a high durability, provides for both optimal protection for the defensive partner and an elastic bounce-back from thrusts and blows landed by the active partner.

With the foregoing and other objects in view there is provided, in accordance with the invention, a hand and forearm protective device for the interception of thrusts in martial arts, especially in body contact sports such as karate, comprising a polyurethane-integral foam mitt or paw for an all-around covering of at least the hand and forearm area of a person, the mitt having a substantially parallelepipedal basic body having a central recess extended longitudinally therethrough for receiving the hand and forearm, the mitt having, in vicinity of an upper end third of the recess, a crosspiece projecting from one side of the recess into the cross section thereof and a gripping trough formed therein laterally adjoining the recess for holding or carrying the mitt with the hand.

Such a hand paw or mitt formed of a soft elastic material offers optimal protection because it can be held simply and safely, and because it safely eliminates any injuries sustained by the forearm and gripping hand, since both of these areas are enclosed by the mitt, which extends over the entire length of the hand.

In accordance with another feature of the invention, the mitt has an end in vicinity of the end third of the recess, and the crosspiece has an upper edge being spaced at a given distance from the end of the mitt.

In accordance with a further feature of the invention, the mitt has convex-cambered or rounded edges and corners all around.

In accordance with an added feature of the invention, the mitt has slightly convex-cambered outer surfaces, for safely excluding any additional danger of injury.

Beyond this, to safely prevent any sweat or dirt from accumulating in the tiny pores, there is provided, in accordance with a concomitant feature of the invention, an elastic lacquer coating disposed on inner and outer surfaces of the mitt which is firmly adhering and which after using can be simply wiped off.

Other features which are considered as characteristic for the invention are set forth in the appended claims.

Although the invention is illustrated and described herein as embodied in a hand and forearm protective device for the interception of thrusts in martial arts, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic top plan view of a mitt of the invention;

FIG. 2 is a longitudinal-sectional view of the mitt of FIG. 1, taken along the line II—II in FIG. 1, in the direction of the arrows;

FIG. 3 is a top plan view of the upper front face of the mitt; and

FIG. 4 is a bottom plan view of the lower front face of the mitt.

Referring now to the figures of the drawing as a whole, it is seen that the mitt in the shape of a paw or hand paw generally designated in the figures with reference symbol 1 includes a one-piece molded part of polyurethane-integral foam. They key advantage of such an integral foam is that it has an almost closed-cell skin surface, which during the foaming process forms a compressed boundary or shell zone, and which changes over into a cellular core in the form of a sandwich. Therefore, the presence of a uniform molecular lattice or network has the effect of producing an extremely high elasticity. Upon the occurence of any deformation and/or impact, the polyurethane integral foam absorbs the kinetic energy, and upon discharging its load bounces back to its original shape. This is accomplished by the fact that because of the closed-cell structure and the non-directionally oriented cell walls, an air cushion brake effect is produced, which assures an absorption of thrusts and an optimal bounce-back therefrom. With formed-in-the-mold or foam-formed workpieces, the compressed, solid skin of the molded part, which changes into the cellular core in the form of a sandwich, is generated from the same material in a single operating stage.

As shown in the figures, the paw or claw-shaped mitt includes an approximately parallelepiped basic body 1 having highly convex-cambered edges and corners all around. Practically speaking, its length amounts to about 30 cm, and the total length to width to thickness ratio is 3:2:1.5. The mitt or paw 1 includes a central recess 2, the elliptical cross section of which at the lower face or front 3 is given the proper size for fitting over the forearm, as also indicated in FIG. 4. The cross section is slightly inwardly tapered, as can be seen specifically from FIG. 2.

At about the upper third of the recess 2, a bar or bridge 5 set off from one of the flat sidewalls of the recess with a diagonal extension or neck 4 projects into the cross section of the recess 2 to adjoin a grip trough or cavity 6 on the side facing away from the recess. The bar or crosspiece 5 is formed in such a way as to be connected from one narrow side of the paw to the other, which can also be seen from the top view of the upper face 7 according to FIG. 3.

To hold the paw in a fixed position, the hand is inserted in the recess 2 and then grips the bar 5 with the fingers, whereby the finger tips lie in the grip cavity or trough 6. For practical reasons, the top edge 8 of the bar or handle 5 is disposed below the upper face 7 of the mitt 1 to the extent that the hand holding the device with its fingers bent into the grip cavity 6 still lies fully within the recess 2, so that even in the event of blows struck on the upper face 7, the hand is fully protected.

Besides its relatively tightly compressed surface, the entire molded part formed of polyurethane-integral foam is additionally coated with an elastic lacquer to close even the tiniest surface pores. Aside from obtaining a better finish, any dirt or sweat is prevented from settling on the surface. The paw can then be easily cleaned by simply washing it off, and thus is constantly ready for use.

The paw according to the invention therefore represents an ideal hand and forearm protector for all martial arts athletes who fight by applying hand and fist blows and/or foot thrusts, ranging for example from body contact sports such as karate to conventional boxing. The paw, which can be safely and easily controlled, can be used in a double-sided manner with its front and rear sides for blow and thrust exercises with hands and feet, and thus is an ideal training cushion for defense against blows such as these. Because if its shape and structural features neither the forearm nor the grip hand can be injured.

I claim:

1. Hand and forearm protective device for the passive interception of thrusts in martial arts, comprising a polyurethane-integral foam cushion for an all-around covering of at least the hand and forearm area of a person, said cushion having a substantially parallelepipedal elongated basic body having open ends and a central continuous channel extended axially therethrough between said open ends for receiving the hand and forearm, said cushion having, in vicinity of an end third of said channel, a crosspiece integral with said basic body projecting from one side of said channel diagonally into the cross section thereof and a gripping trough formed in said crosspiece laterally adjoining said channel for holding said cushion with the hand, said channel being substantially straight and one of said open ends exposing the fingers of the person within the basic body to view from outside said one end.

2. Hand and forearm protective device according to claim 1, wherein said cushion has an end in vicinity of said end third of said recess, and said crosspiece has an upper edge being spaced at a given distance from said end of said mitt.

3. Hand and forearm protective device according to claim 1 or 2, wherein said cushion has convex-cambered edges and corners all around.

4. Hand and forearm protective device according to claim 1 or 2, wherein said cushion has convex-cambered outer surfaces.

5. Hand and forearm protective device according to claim 1 or 2, including an elastic lacquer coating disposed on inner and outer surfaces of said cushion.

* * * * *